US008083277B1

(12) United States Patent
Benjamin et al.

(10) Patent No.: US 8,083,277 B1
(45) Date of Patent: Dec. 27, 2011

(54) PICK END TOOL

(75) Inventors: Eric Gregg Benjamin, Carmel, IN (US); Masahiko Minamikawa, Columbus, IN (US); Toshihide Tanaka, Indianapolis, IN (US); John Campbell, East Liberty, OH (US); David Wayne Hicks, Shelbyville, IN (US)

(73) Assignees: Honda Motor Co., Ltd., Tokyo (JP); Midwest Express Inc., East Liberty, OH (US)

( * ) Notice: Subject to any disclaimer, the term of this patent is extended or adjusted under 35 U.S.C. 154(b) by 449 days.

(21) Appl. No.: 12/240,875

(22) Filed: Sep. 29, 2008

(51) Int. Cl.
*B66C 1/42* (2006.01)

(52) U.S. Cl. ..... 294/86.41; 294/67.33; 294/117

(58) Field of Classification Search ..... 294/67.3, 294/67.33, 117, 81.5, 81.6, 86.41; 248/651, 248/646
See application file for complete search history.

(56) References Cited

U.S. PATENT DOCUMENTS

| | | | | |
|---|---|---|---|---|
| 3,261,637 | A | 7/1966 | Bopp et al. | |
| 3,273,931 | A * | 9/1966 | Caldwell et al. | 294/106 |
| 4,563,031 | A * | 1/1986 | Kishimoto et al. | 294/81.21 |
| 5,338,150 | A | 8/1994 | Focke et al. | |
| 5,429,490 | A * | 7/1995 | Myers et al. | 425/436 R |
| 5,431,471 | A | 7/1995 | Baumann | |
| 5,582,451 | A | 12/1996 | Baumann | |
| 5,915,673 | A | 6/1999 | Kazerooni | |
| 5,971,456 | A * | 10/1999 | van Capelleveen | 294/88 |
| 6,062,620 | A | 5/2000 | Walker et al. | |
| 6,138,846 | A * | 10/2000 | Baumann | 212/326 |
| 6,749,392 | B1 * | 6/2004 | Adams et al. | 414/800 |
| 7,210,589 | B2 * | 5/2007 | Iizuka | 212/273 |
| 2009/0081006 | A1 | 3/2009 | Williamson | |

* cited by examiner

*Primary Examiner* — Saul Rodriguez
*Assistant Examiner* — Stephen Vu
(74) *Attorney, Agent, or Firm* — Standley Law Group LLP

(57) ABSTRACT

Exemplary embodiments provide a grasping and lifting device for moving a plurality of different-sized containers. The dimensions of the grasping device do not have to be adjusted prior to engaging a container which allows an operator to move a variety of different-sized containers in a short period of time. A hoisting device with a counter weight provides lift and motion assistance to the operator so that the risk of repetitive motion injury is reduced.

18 Claims, 4 Drawing Sheets

PICK END TOOL

CROSS-REFERENCE TO RELATED APPLICATIONS

This application is a non-provisional patent application and does not claim priority to any applications.

TECHNICAL FIELD

Exemplary embodiments relate generally to a device for grasping and lifting various containers.

BACKGROUND AND SUMMARY OF EXEMPLARY EMBODIMENTS

In large assembly plants, the movement of materials and subassemblies around the plant can be a critically important task to the overall function of the plant. Each station on the assembly line must have an adequate supply of materials so that the line is not stopped in order to re-stock any individual stations. If the line must be stopped, the plant is losing efficiency, and with a loss of efficiency ultimately comes a loss of money.

However, a large volume of parts cannot be stored at each station for a number of reasons. First, there may be a lack of space within the assembly area of the plant to store any parts. Secondly, purchasing and storing a large back-stock of assembly materials may be a waste of precious capital, especially when parts may sit in storage for several weeks before actually being assembled. The demands of the modern assembly plant have created several streamlined material distribution methods. One method of note is 'just in time' (JIT) manufacturing. When practicing this type of distribution method, parts must move quickly from the supplier's factory to the final assembly line with little time and space wasted in between. In a large assembly plant which produces a high volume of outgoing products, moving thousands of parts around to hundreds of different workstations can be a daunting task.

In order to accomplish this, new ways of packaging parts to be assembled must be developed and corresponding methods for quickly sorting and moving these packaged parts must also be realized. Several problems exist however with current distribution systems. First, the size of assembly parts may vary widely, thus necessitating a different size and shaped container for each group of parts. For example, a day's supply of 3 mm nuts for attaching a small component may be much smaller than a day's supply of motor subassemblies. Thus, any distribution and sorting system must be able to accommodate a variety of different-sized containers. Secondly, when a plurality of different-sized containers move along a guided rail or roller system, the spacing between the containers may vary widely. Gaps between the containers may vary between several feet and several inches, and some containers may abut against one another leaving no gap whatsoever.

Modern assembly plants also pay close attention to the stress and strain that is put on the plant workforce. Most notably, injury from repetitive motions must be reduced or eliminated to ensure that a trained workforce may continue to work and not be forced to miss work due to a repetitive motion injury. Therefore, any distribution system must account for these concerns and place the smallest amount of stress on a worker as possible. Lift-assist devices have become popular, allowing a worker to lift and move a heavy object with very little bodily stress or risk of injury.

The exemplary embodiments herein allow a worker to grasp a variety of different containers, whether they are immediately next to one another or spaced widely apart. The device allows a plurality of containers to be used, from somewhat small to awkward and large, which allows the suppliers to package their parts in the most appropriate and efficient container for the application. Further, exemplary embodiments allow a worker to quickly grasp, lift, and move large containers with very little stress on their body.

The exemplary embodiments herein disclosed are not intended to be exhaustive or to unnecessarily limit the scope of the embodiments. The exemplary embodiments were chosen and described in order to explain the principles so that others skilled in the art may practice the embodiments. Having shown and described exemplary embodiments, those skilled in the art will realize that many variations and modifications may be made to affect the described invention. Many of those variations and modifications will provide the same result and fall within the spirit of the exemplary embodiments. It is the intention, therefore, to limit the embodiments only as indicated by the scope of the claims.

BRIEF DESCRIPTION OF THE DRAWINGS

A better understanding will be obtained from a reading of the following detailed description and the accompanying drawings wherein identical reference characters refer to identical parts and in which.

DETAILED DESCRIPTION OF PREFERRED EMBODIMENTS

Figure 1:
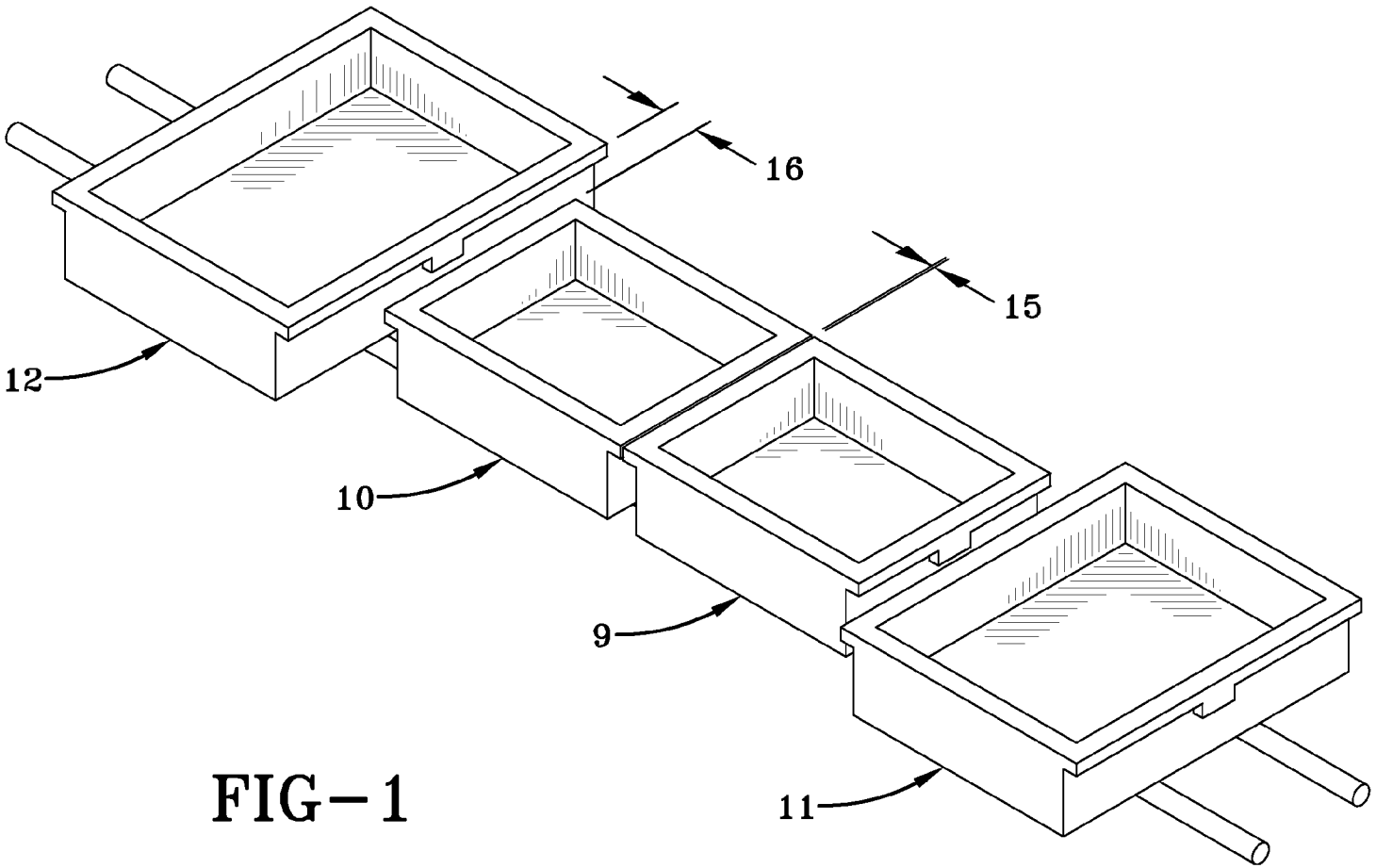
FIG. 1 is a perspective view of several different-sized containers and the variety of gaps in between them.

In FIG. 1, three different sized containers are shown with two different gaps. Containers 9 and 10 are similarly sized and show a very small gap to near abutment 15 between the two containers. Container 11 is deeper than containers 9 and 10 while container 12 is still deeper than container 11. Gap 16 is larger than gap 15 and may be on the order of 3-6 inches. Much larger gaps are of course possible, and this first Figure is simply showing an example of how various containers may be received through a typical roller or conveyer system. It should be noted that each container may have a similar width dimension, while both the depth of the container and the height of the container may vary widely.

Figure 2A:
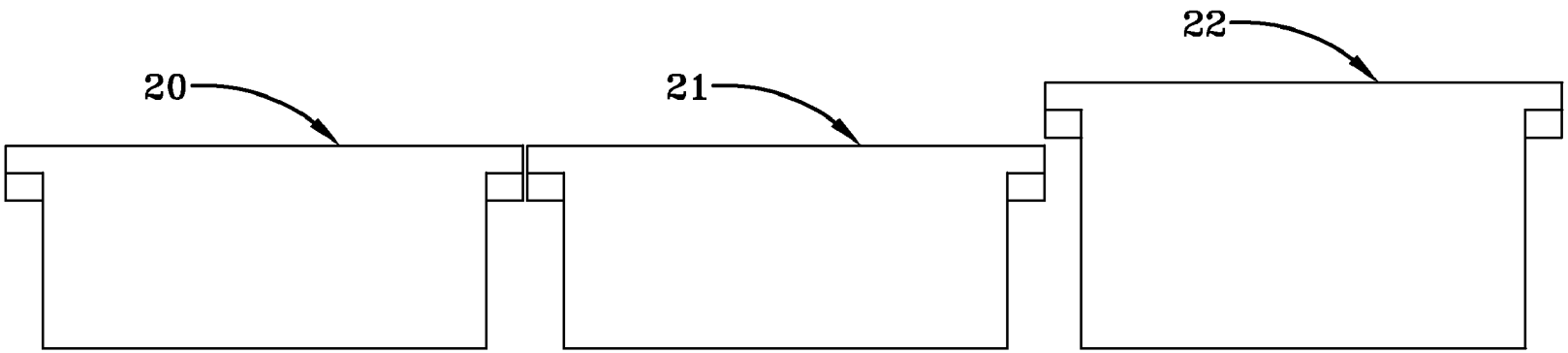
FIG. 2A is a side view of containers where they abut against each other.

In FIG. 2A, several containers are shown, where containers 20 and 21 have a similar height dimension while container 22 has a larger height dimension. Often, containers may enter a transfer area in an improper order or simply in a situation where there is no order but the worker would like to access a container which is surrounded by other containers. Here, container 21 may be considered this type of container, known herein as a 'central container.' Accessing these containers can be difficult as there is no direct access point on either side since containers 20 and 22 abut against opposing sides of the central container 21.

Figure 2B:
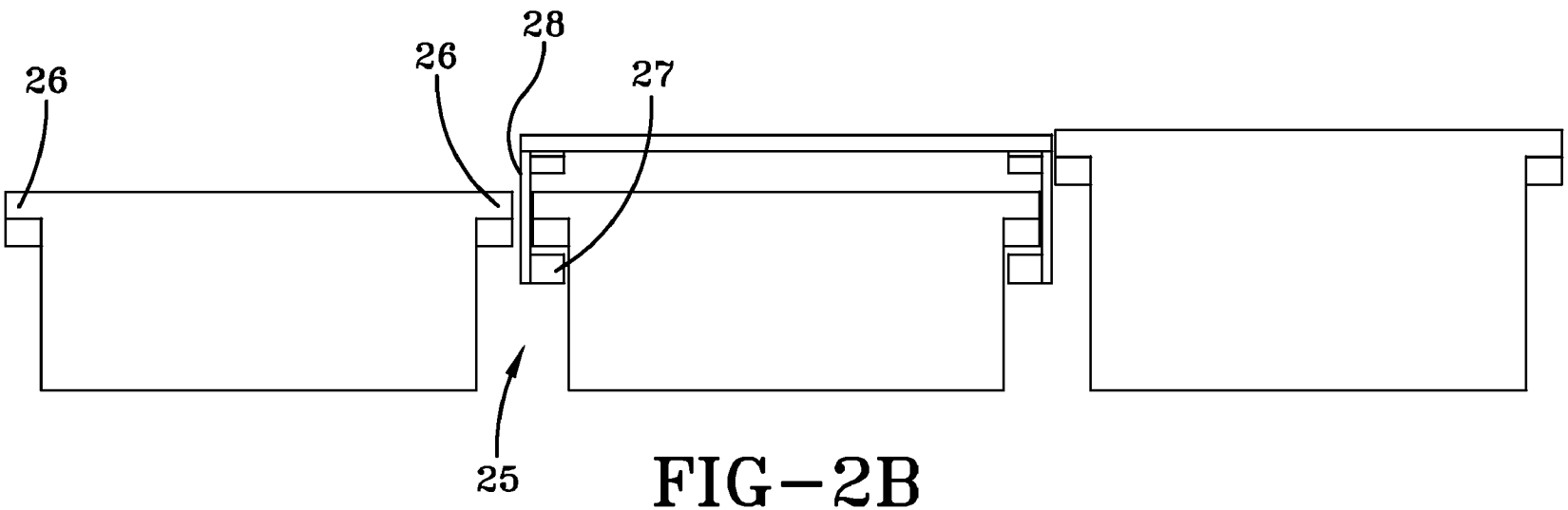
FIG. 2B is a side view of abutting containers where an exemplary embodiment is being utilized to grasp a central container.
Figure 4A:
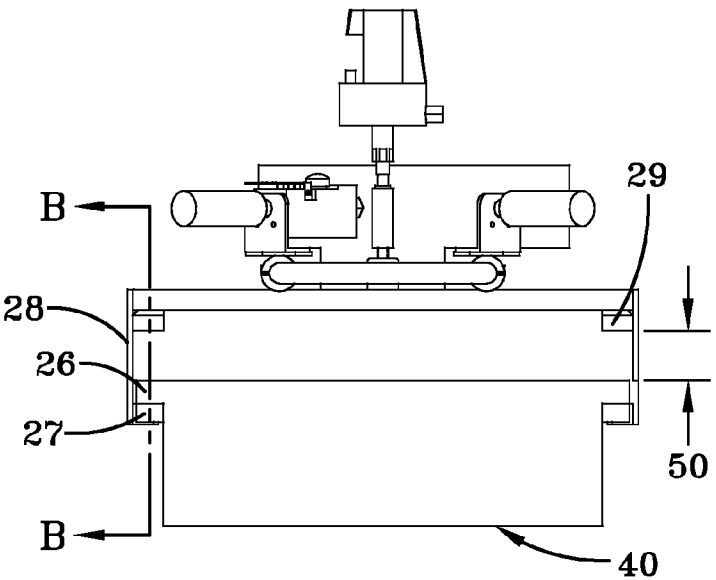
FIG. 4A is a side view of an exemplary embodiment which has engaged a container.
Figure 4B:
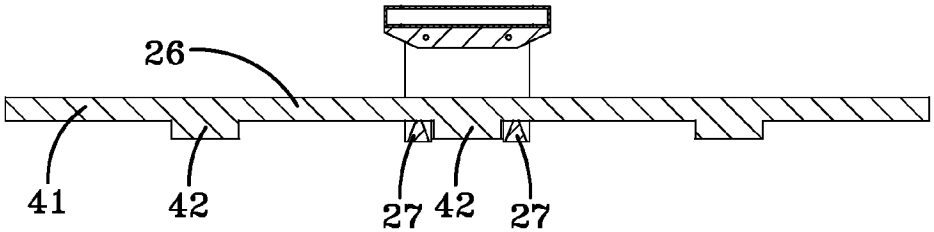
FIG. 4B is a cross-sectional view of the embodiment of FIG. 4A showing the interaction between the lifting lugs and the container.
Figure 4C:
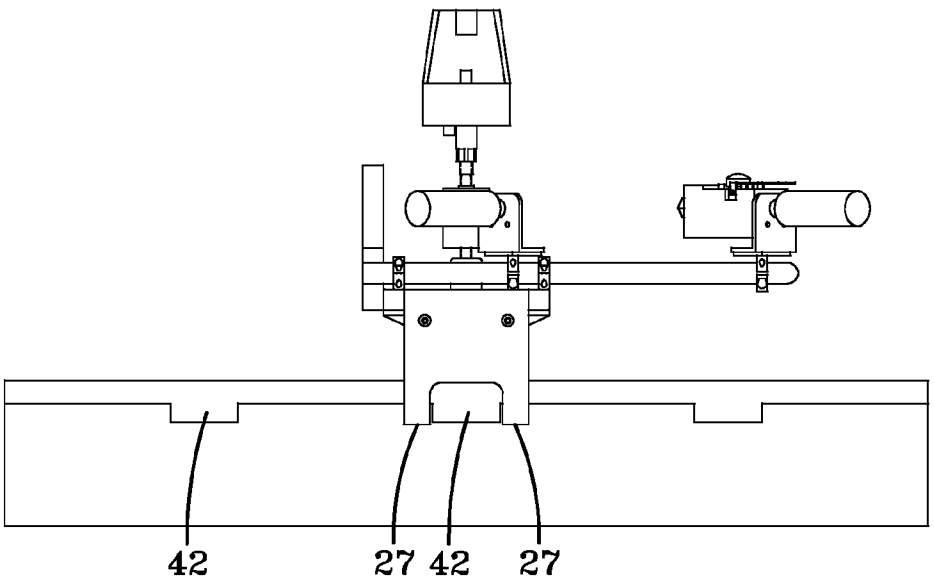
FIG. 4C is a front view showing the interaction between the lifting lugs and the container.

FIG. 2B shows an exemplary embodiment which takes advantage of gap 25 which is created by the hoisting ledges 26. Lift lugs 27 can pass through gap 25 as the lift plate 28 separates the containers and passes between the hoisting ledges 26. The lift plate 28 should be relatively thin so that it can separate and pass between containers. Optionally, the edge of the lift plate 28 may have a chamfer and/or edge so that the plate can more easily separate containers. The embodiment shown has not engaged the container yet (i.e. the lift lugs are not contacting the hoisting ledges 26 and lifting the container). An embodiment where the container is engaged is shown in FIGS. 4A-4C.

Figure 3:
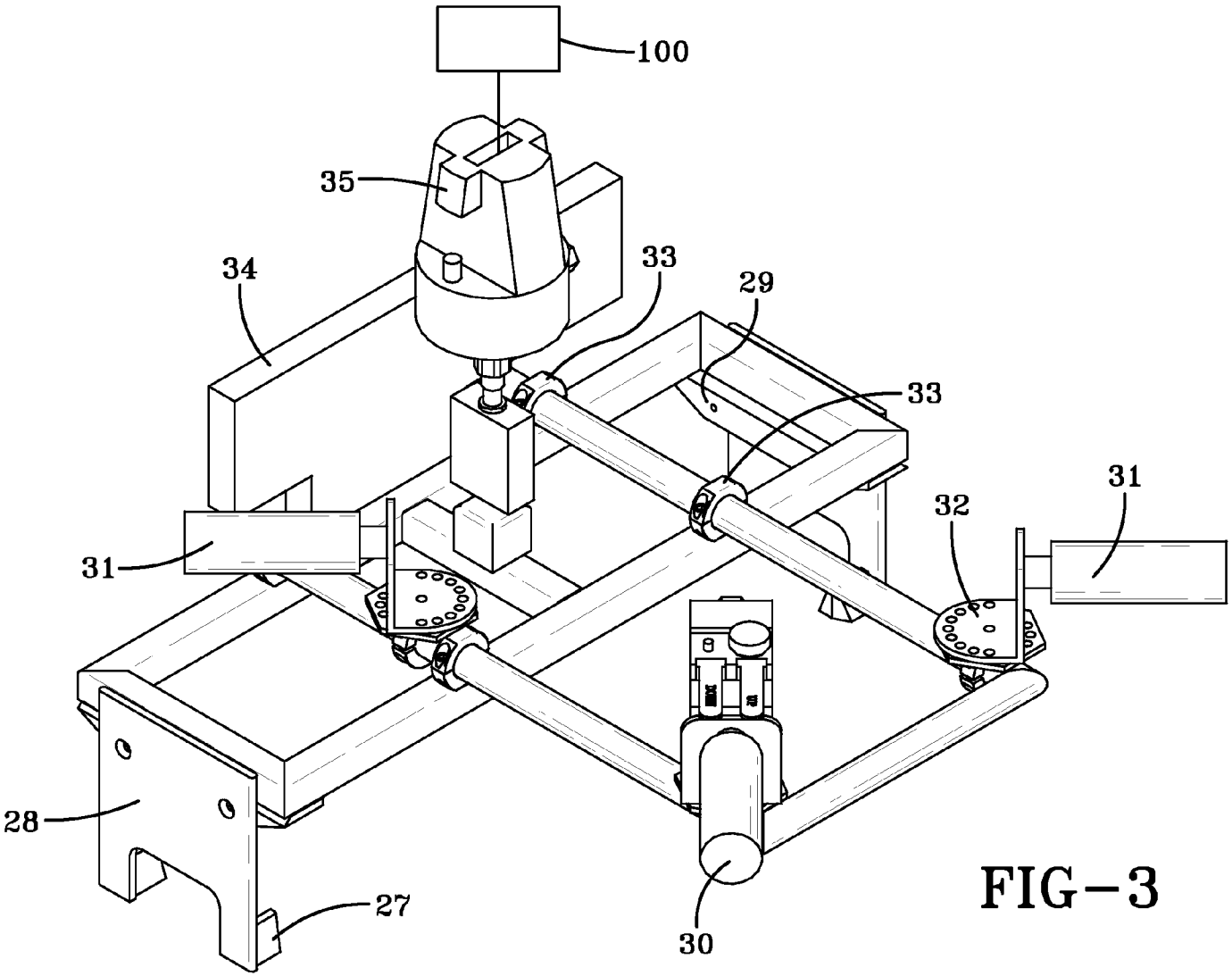
FIG. 3 is a perspective view of an exemplary embodiment of the grasping device.

FIG. 3 shows an exemplary embodiment of the grasping device. Lift lugs 27 are attached at the base of lift plate 28. A skid pad 29 is shown adjacent to the lift plate 28. A skid pad is an optional device that can facilitate the grasping device's ability to slide over a container and into the appropriate lifting position. Preferably, a skid pad would be comprised of materials that would not damage the containers or the skid pad itself when slid over the container edge surfaces. A skid pad may also be comprised of materials that would provide a low coefficient of friction between the container surfaces and the skid pad. Thus, in an exemplary embodiment a skid pad may be made of delrin or another type of durable, low friction plastic.

An exemplary embodiment may have three operator handles. A first handle, known as the actuator handle 30, may contain the actuators for the hoisting device 100. Two additional handles may also be used and may be known as blank handles 31, i.e. they do not contain actuators. The blank handles 31 are used for positioning the device at the proper lifting position, balancing the container and grasping device once hoisted into the air, relocating the container, and removing the device from the container once in the final desired location. The actuator handle 30 can also serve any of these functions, but also contains actuators for a hoisting device 100. The actuator handle 30 and the corresponding controls for a hoisting device 100 are commercially available from Corbel, Inc. in Fishers, N.Y. www.gorbel.com.

Each of the handles may have an angular adjustment 32 and a plurality of different locking collars 33, so that the positioning of the handles can be adjusted for the operator's size, container size, and specific relocation movements. A counter weight 34 may be used to help balance the container once it has been lifted and provide some leverage for the operator to position the grasping device under a desired container. An electrical collector 35 may be used to electrically connect the actuator assembly with the hoisting device 100. The electrical collector 35 may also provide a physical attachment of the hoisting device 100 to the grasping device.

Embodiments can contain any number of different types and styles of hoisting devices, including but not limited to bridge cranes, jib cranes, and intelligent lifting devices. An exemplary embodiment might utilize an I-beam jib crane. Exemplary hoisting devices 100 are commercially available from Corbel, Inc. in Fishers, N.Y. www.gorbel.com.

FIG. 4A shows an exemplary embodiment with a container 40 engaged. The lift lugs 27 are adjacent to the hoisting ledges 26. The lift plate 28 should have a relatively close fit against the hoisting ledges 26 so that the lift plate 28 can slide between adjacent containers and/or force adjacent containers apart.

FIG. 4B shows the cross-sectional view of cross section B-B which is shown in FIG. 4A. The hoisting ledge 26 may comprise at least two types of features, a lifting feature 41 and a stabilizing feature 42. The lifting feature 41 may be a ledge which engages with the lift lugs 27 to provide an upward force to lift the container. The stabilizing feature 42 may be surrounded by the lift lugs 27 to prevent the container from sliding off or rotating so as to dump its contents. The clearance between the lift lugs 27 and the stabilizing feature 42 should be chosen so that it is loose enough to allow the lift lugs 27 to easily slip over the stabilizing feature 42 but tight enough so that the container is adequately secured. In an exemplary embodiment, a clearance of 0.20-0.30 inches on each side of the stabilizing feature 42 may be used.

FIG. 4C shows the side view and the interaction between the stabilizing feature 42 and the lift lugs 27. Also, attention should be paid to clearance 50 (shown in FIG. 4A), which is the distance between the top surface of the container 40 and the skid pad 29. As shown in FIG. 4C there may be several stabilizing features 42 on the side of the container but only the center feature may be used to lift the container (to reduce the risk of tipping and dropping the container). However, the other stabilizing features 42 may still be used by the operator to move the container around, especially for sliding and aligning a container once it has been placed or prior to lifting it. The size of clearance 50 should be selected to ensure that the lifting lugs can pass underneath stabilizing features 42 which are not desired by the operator.

It should be recognized that containers are only constrained in the width dimension. For example, containers may be virtually any depth and any height and may still be compatible with the exemplary embodiments. This flexibility in container size allows suppliers to package and ship parts in the most appropriate containers for both the supplier and the end assembly plant. Further, an operator can select any container and slide, lift and relocate it, without having to take containers in the order that they come through the conveyor or roller system. Only a small amount of stress would be place on the operator's body, as the lifting is assisted by a hoisting device and any translational movements are assisted by a translating mechanism. This translating mechanism could be any type of rotating arm or boom and possibly in combination with any type of sliding movement on wheels or bearings. No time must be taken to re-size the dimensions of the grasping mechanism for any specific container, which allows the operator to move a variety of different-sized containers in a short amount of time.

Having shown and described preferred embodiments, those skilled in the art will realize that many variations and modifications may be made to affect the described embodiments and still be within the scope of the claims. Thus, many of the elements indicated above may be altered or replaced by different elements which will provide the same result and fall within the spirit of the claimed embodiments. It is the intention, therefore, to limit the invention only as indicated by the scope of the claims.

What is claimed is:

1. A grasping apparatus for grasping any selected one of a plurality of containers having different heights and depths with similarly sized widths and stabilizing features along with a horizontal lifting ledge, the grasping apparatus comprising:

a frame;

a skid pad attached to said frame and adapted to slide along the horizontal lifting ledge as a container is being grasped;

two lifting plates attached to said frame and extending down in a generally vertical direction, the lifting plates being spaced apart to correspond with the width of the containers;

lift lugs attached to each of the lifting plates and spaced apart to correspond with the stabilizing features;

an operator handle attached to a side of said frame;

a hoisting device attached to said frame; and an actuator attached to said frame and electrically connected to said hoisting device.

2. The grasping apparatus of claim 1, further comprising:

a counterweight attached to said frame.

3. The grasping apparatus of claim 2, wherein:

the counterweight is located on an opposing side of the frame as the operator handle.

4. The grasping apparatus of claim 1, wherein:

the skid pad is comprised of delrin.

5. The grasping apparatus of claim 1, wherein:

the skid pad is comprised of plastic.

6. The grasping apparatus of claim 1, wherein:

the operator handle is adjustably attached to the frame.

7. The grasping apparatus of claim 1, wherein:

the hoisting device is an I-beam jib crane.

8. The grasping apparatus of claim 1, wherein:

the lifting plates and lift lugs are in a fixed position relative to one another.

9. A method for grasping and moving containers, wherein the method comprising the steps of:

presenting the grasping apparatus, said grasping apparatus comprising:

(1) a frame;

(2) two lifting plates attached to said frame and extending down in a generally vertical direction, the lifting plates being spaced apart to correspond with the width of the containers;

(3) lift lugs attached to each of the lifting plates and spaced apart to correspond with the stabilizing features;

(4) an operator handle attached to said frame;

(5) a hoisting device attached to said frame;

(6) an actuator attached to said frame and electrically connected to said hoisting device; and (7) a skid pad attached to the frame;

presenting a plurality of linearly oriented containers having different heights and depths with similarly sized widths and stabilizing features, the containers also having horizontal hoisting ledges;

selecting a container for moving;

lowering the frame until the lift lugs are at a lower height than the stabilizing features of the selected container;

moving the grasping apparatus horizontally while sliding the skid pad along the horizontal hoisting ledges until the lifting lugs are below the stabilizing features of the selected container;

raising the grasping apparatus until the lifting lugs are adjacent to the lifting ledge and surrounding the stabilizing features of the selected container; and moving the selected container.

10. The method of claim 9 wherein:

the lowering and raising steps are performed by the actuator electrically communicating with the hoisting device.

11. The method of claim 9 further comprising the steps of:

lowering the selected container onto a surface until the selected container has touched the surface and the lift lugs are at a lower height than the stabilizing features; and moving the grasping apparatus horizontally until the lifting lugs are clear of the lifting ledge of the selected container.

12. The method of claim 9 further comprising the step of:

separating the selected container from any adjacent containers by using the lifting plates while performing the step of moving the grasping apparatus horizontally.

13. A system for handling containers of various sizes, the system comprising:

a plurality of containers having:

varying height and depth dimensions, similar width dimensions, horizontal hoisting ledges having bottom and top surfaces, and a stabilizing feature on the bottom of each of the hoisting ledges, each of the stabilizing features having opposing sides;

a grasping apparatus having:

a frame;

two lifting plates attached to said frame and extending down in a generally vertical direction, the lifting plates being spaced apart to correspond with the width of the containers;

lift lugs attached to each of the lifting plates and spaced apart to correspond with the opposing sides of the stabilizing features such that the lift lugs are adjacent to the opposing sides of the stabilizing features when a container is being grasped;

wherein the lifting plates and lift lugs are in a fixed position relative to each other;

an operator handle attached to said frame;

a skid pad attached to the frame which slides along the top surface of the hoisting ledge as a container is being grasped; and a hoisting device attached to said frame; and an actuator attached to the operator handle and electrically connected to said hoisting device.

14. The system of claim 13 further comprising:

a counterweight attached to said frame.

15. The system of claim 13 wherein:

the skid pads are comprised of delrin.

16. The system of claim 13 wherein:

the skid pads are comprised of plastic.

17. The system of claim 13 wherein:

the operator handle is adjustably attached to the frame.

18. The system of claim 13 wherein:

the hoisting device is an I-beam jib crane.

* * * * *